US008590849B2

(12) United States Patent
Melic

(10) Patent No.: US 8,590,849 B2
(45) Date of Patent: Nov. 26, 2013

(54) LOCKING AND LIFTING MECHANISM FOR SAFETY FENCE SUPPORT POST

(76) Inventor: Jonathan Jonny Melic, Stoney Creek (CA)

( * ) Notice: Subject to any disclaimer, the term of this patent is extended or adjusted under 35 U.S.C. 154(b) by 980 days.

(21) Appl. No.: 11/990,091

(22) PCT Filed: Aug. 9, 2006

(86) PCT No.: PCT/CA2006/001309

§ 371 (c)(1), (2), (4) Date: Aug. 12, 2010

(87) PCT Pub. No.: WO2007/016785

PCT Pub. Date: Feb. 15, 2007

(65) Prior Publication Data

US 2011/0042539 A1 Feb. 24, 2011

(30) Foreign Application Priority Data

Aug. 10, 2005 (CA) ..... 2515750

(51) Int. Cl.
*E04G 25/00* (2006.01)
*A47F 5/00* (2006.01)

(52) U.S. Cl.
USPC ..... 248/200.1; 248/161; 248/188.2; 248/354.1; 254/108; 403/104; 403/109.1; 403/374.5; 52/126.1

(58) Field of Classification Search
USPC ..... 248/354.1, 188.1, 188.2, 188.5, 188.8, 248/200.1, 218.4, 161; 403/104, 109.1, 403/109.3, 109.5, 109.8, 110, 374.5, 377; 254/108; 52/126.1, 126.6
See application file for complete search history.

(56) References Cited

U.S. PATENT DOCUMENTS

| | | | |
|---|---|---|---|
| 1,516,616 | A | 11/1924 | Meyer |
| 1,639,551 | A | 8/1927 | Booth |
| 2,403,338 | A | 7/1946 | Butler |

(Continued)

FOREIGN PATENT DOCUMENTS

| | | |
|---|---|---|
| AU | 603455 | 12/2008 |
| BE | 538792 | 6/1955 |

(Continued)

OTHER PUBLICATIONS

Office Action dated Aug. 5, 2010, U.S. Appl. No. 12/392,534.

(Continued)

*Primary Examiner* — Tan Le
(74) *Attorney, Agent, or Firm* — Honigman Miller Schwartz and Cohn LLP

(57) ABSTRACT

A support post for a safety fence assembly. The support post has a floor engaging end that has a number of claws, a shaft coupled at one end to the floor engaging end, a first longitudinally extending telescoping tube, a second longitudinally extending telescoping tube adapted for sliding telescoping engagement with the first telescoping tube, a ceiling engaging end, and an over-center locking lever assembly. Each of the claws has a number of sharp penetrating points for engagement with a supporting surface. The shaft has a free end which is threaded along at least a portion of its length. The first longitudinally extending telescoping tube has an internal nut for threaded engagement with the shaft. The ceiling engaging end is coupled to the second telescoping tube. The over-center locking lever assembly fixes the relative position of the first and second telescoping tubes.

21 Claims, 13 Drawing Sheets

(56) References Cited

U.S. PATENT DOCUMENTS

| | | | | | |
|---|---|---|---|---|---|
| 2,903,227 | A | | 9/1959 | Kalb | |
| 2,991,040 | A | | 7/1961 | Levy | |
| 3,143,331 | A | | 8/1964 | Corey | |
| 3,329,105 | A | | 7/1967 | McPherson | |
| 3,333,808 | A | * | 8/1967 | Du Boff | 248/200.1 |
| 3,439,898 | A | | 4/1969 | Cleveland et al. | |
| 3,589,682 | A | | 6/1971 | Dickey | |
| 3,635,352 | A | | 1/1972 | Brooks et al. | |
| 3,662,993 | A | | 5/1972 | Lionetto | |
| 3,734,441 | A | * | 5/1973 | Lux | 248/354.1 |
| 3,734,467 | A | | 5/1973 | Weeden | |
| 3,822,850 | A | * | 7/1974 | Elias | 248/551 |
| 3,883,106 | A | * | 5/1975 | Simonsen | 254/106 |
| 3,917,208 | A | | 11/1975 | Magers | |
| 3,920,220 | A | | 11/1975 | Elias | |
| 3,946,992 | A | | 3/1976 | Elias | |
| 3,961,822 | A | | 6/1976 | Daniel | |
| 3,980,278 | A | * | 9/1976 | Elias | 256/59 |
| 4,039,047 | A | | 8/1977 | Larson et al. | |
| 4,272,058 | A | | 6/1981 | Van Santen | |
| 4,433,669 | A | | 2/1984 | Ishikawa et al. | |
| 4,518,141 | A | | 5/1985 | Parkin | |
| 4,733,844 | A | * | 3/1988 | Molloy | 248/354.1 |
| 4,761,092 | A | | 8/1988 | Nakatani | |
| 4,928,916 | A | * | 5/1990 | Molloy | 248/354.1 |
| 5,154,449 | A | | 10/1992 | Suei-Long | |
| 5,228,810 | A | | 7/1993 | Seegmiller | |
| 5,303,832 | A | | 4/1994 | Tu | |
| 5,472,301 | A | * | 12/1995 | Wallen | 410/151 |
| 5,833,081 | A | | 11/1998 | Smith | |
| 5,924,469 | A | | 7/1999 | Whittemore | |
| 5,988,963 | A | | 11/1999 | Shiau | |
| 6,247,882 | B1 | | 6/2001 | Huang | |
| 6,536,723 | B1 | | 3/2003 | Nakatani | |
| 6,554,235 | B1 | | 4/2003 | Fortier | |
| 6,612,533 | B2 | | 9/2003 | Biles et al. | |
| 6,679,482 | B2 | | 1/2004 | Allenbaugh | |
| 6,786,302 | B2 | | 9/2004 | Liew et al. | |
| 6,953,076 | B2 | | 10/2005 | Whittemore | |
| 7,086,633 | B2 | * | 8/2006 | Welch et al. | 248/218.4 |
| 7,255,312 | B2 | | 8/2007 | Melic | |
| 7,267,310 | B2 | * | 9/2007 | Welch et al. | 248/218.4 |
| 7,273,200 | B2 | | 9/2007 | Funes Gavilan | |
| 7,275,731 | B1 | | 10/2007 | Shinault | |
| 7,290,742 | B2 | | 11/2007 | Wang | |
| 8,002,229 | B2 | * | 8/2011 | Hewson | 248/410 |
| 8,152,118 | B2 | * | 4/2012 | Melic | 248/200.1 |
| 2007/0252054 | A1 | | 11/2007 | Melic | |
| 2007/0257180 | A1 | | 11/2007 | Melic | |

FOREIGN PATENT DOCUMENTS

| | | |
|---|---|---|
| CA | 1291356 | 10/1991 |
| CA | 2351905 | 9/2001 |
| CA | 2418165 | 10/2008 |
| DE | 837770 | 5/1952 |
| EP | 06775089.3 | 5/1952 |
| EP | 05770399.3 | 5/2007 |
| EP | 1921226 | 5/2008 |
| FR | 369806 | 1/1907 |
| WO | WO 2006/010270 | 2/2006 |
| WO | WO 2007/016785 | 2/2007 |

OTHER PUBLICATIONS

Canadian Office Action for Application Serial No. 2,515,750 dated Aug. 24, 2012.

Photographs of a third party's device dated on or about Nov. 5, 2008.

* cited by examiner

LOCKING AND LIFTING MECHANISM FOR SAFETY FENCE SUPPORT POST

TECHNICAL FIELD

This invention relates to a support post for use with a fence assembly at a construction site. In particular, the invention relates to a locking and lifting mechanism for securing telescoping inner and outer tubes comprising a support post.

BACKGROUND ART

Safety barriers or fences are used during the construction of high-rise buildings to prevent construction workers from falling from the building and injuring themselves. They are also useful to prevent materials from falling from the building and for catching any flying debris being blown against the barriers and injuring people below. The safety barriers need to be set up and taken down with relative ease since they are temporary and frequently moved from one location to another as the construction progresses. A safety barrier of this type typically comprises a plurality of posts supporting intervening fence panels.

Various types of support posts and fencing assemblies have been designed to try and address this need for a safety barrier. U.S. Pat. No. 3,822,850 discloses a support for a construction fence. The support comprises a telescoping jack post which can be adjusted to fit snuggly between a floor and ceiling. U.S. Pat. No. 3,589,682 discloses another type of telescopic fence column which has a manually operable jacking system and upper and lower pads for contacting the ceiling and floor of a portion of the building. U.S. Pat. No. 3,946,992 discloses another type of construction fence post which comprises a C-shaped bracket which is used to clamp the post to the edge of the floor section. U.S. Pat. No. 3,734,467 describes an upright for a wall partition which has a compression spring that allows for frictional engagement of the upright between floors of a building under construction. U.S. Pat. No. 6,679,482 discloses an improved construction perimeter guide stanchion. An adjustment system allows one to tightly clamp the pair of jaws at the lower end of the stanchion to the edge of a floor slab in an elevated unfinished building.

Although many attempts have been made to design improved safety barrier systems, there remains a need for a system that is easily erected and dismantled and which is self-adjusting, easily packaged safer and tamper-proof. In Applicant's co-pending U.S. patent application Ser. No. 10/901,141, there is provided a support post and safety fence assembly in which the post has a telescoping inner and outer tube and is supported on a threaded internal shaft coupled to a floor engaging end. A ceiling engaging end is preferably formed with claws that have a number of sharp penetrating points for firm engagement with a support surface. Dynamic adjustability of the support post is provided by internal compression springs which also allow the post to be temporarily positioned in an upright position prior to securement.

DISCLOSURE OF INVENTION

In accordance with this invention, there is provided a support post having an over-centre locking lever assembly for fixing the relative position of telescoping inner and outer tubes in a support post for a safety fence assembly. The locking lever assembly includes a collar slideable longitudinally over the telescoping inner tube and a lever pivotally mounted to the collar on a pivot pin and pivotable between a release position where the collar is freely movable on the telescoping inner tube and a lock position where the lever has moved past a center line and the collar is tilted to grip the telescoping inner tube. Preferably, the lever is bifurcated at an inner end into a pair of cam portions that receive the pivot pin therebetween. The cam portions will bear against an upper pheripheral edge of the telescoping outer tube and have a curvature and shape adapted to raise the pivot pin so that the collar is raised above the upper peripheral edge of the telescoping outer tube and tilted to grip an outer surface of the telescoping inner tube.

BEST MODE FOR CARRYING OUT THE INVENTION

Figure 12:
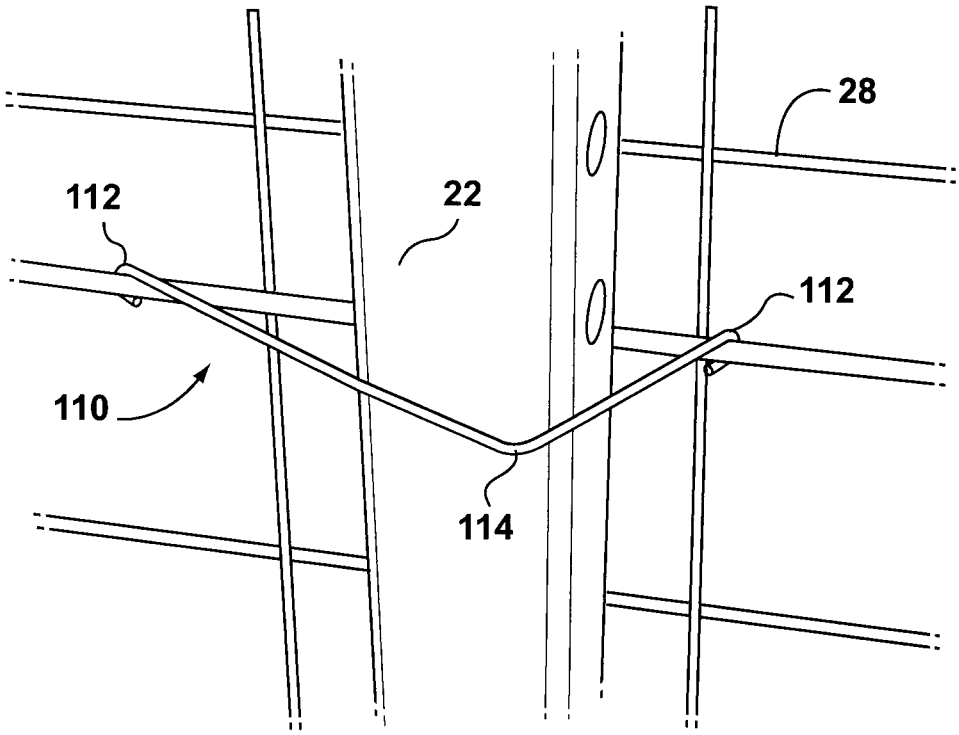
FIG. 12 is a perspective view showing a wire clip for securely coupling a support post to a safety fence panel.

The invention provides a safety fence assembly generally indicated by reference numeral 20 and consisting of a plurality of upright support posts 22 that extend between a supporting surface or floor 24 and a ceiling 26. The posts are normally positioned adjacent to an opening and spaced apart by a distance commensurate with the length of an associated fence panel or barrier 28. The fence panel 28 is normally positioned on the interior side of the associated support post 22 and thus in the view of FIG. 1, the observer would be looking out of a building, the floor 24 and ceiling 26 having been drawn in cross-section. As will be appreciated by those skilled in the art, the safety fence assembly 20 may be used in a number of circumstances according to the needs at the building site. To better secure the support post 22 to the fence panel 28, a wire clip 110 may be used in accordance with the invention. As seen in FIG. 12, the wire clip consists of wire having a diameter of 0.085 (in) suitable for bending into an open hook 112 at opposite ends of a length of 8.4 (in). The wire length has a bend 114 between its ends at an angle of 75° so that the clip may straddle a post 22 as shown. The hooks 112 are adapted to lock into position on wire mesh forming the fence panel 28.

Figure 2B:
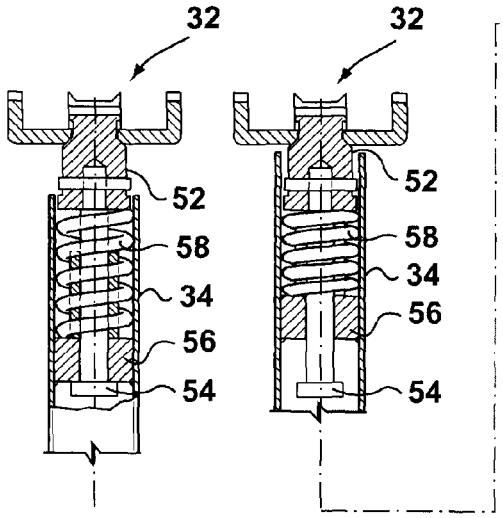
FIG. 2*b* is a cross-sectional view showing a top end of the post of FIG. 2*a* in a relaxed configuration.
Figure 2C:
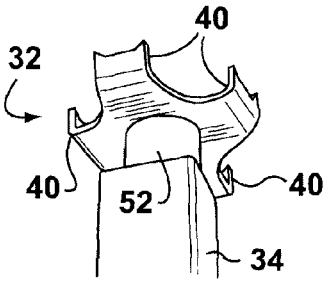
FIG. 2*c* is a perspective view showing the top end of the post of FIG. 2*a;*
Figure 6:
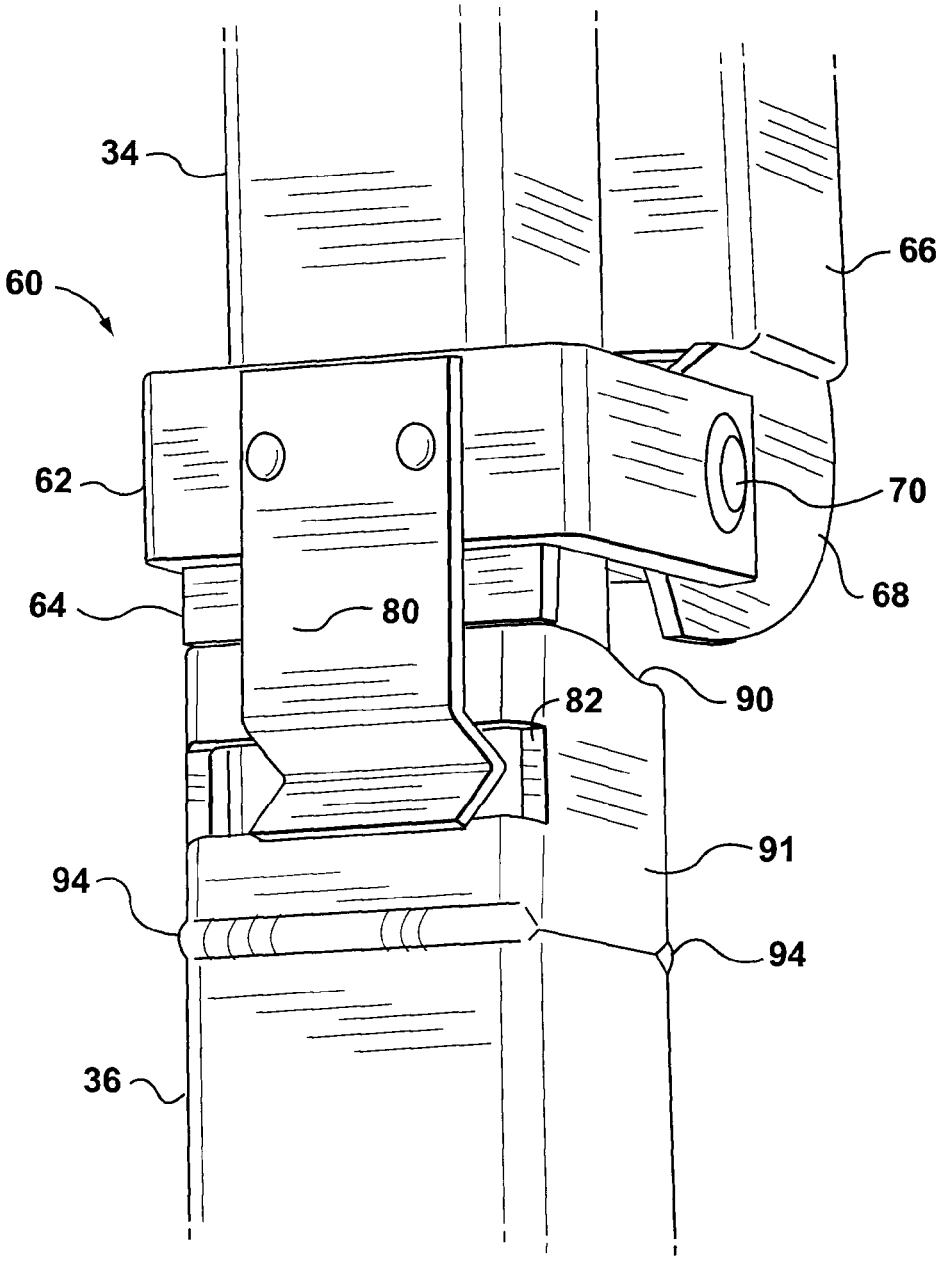
FIG. 6 is a perspective view (drawn to a larger scale) showing the locking lever assembly in a release position.

The construction of the support post 22 is shown in more detail in FIGS. 2*a* through 2*d*. An overall view of the support post 22 is provided in FIG. 3 where it will be observed that the support post has a floor engaging end or foot 30 at one end and a similar ceiling engaging end 32 at the opposite end with a pair of telescoping inner and outer tubes 34, 36 in between. As will be seen from FIG. 6, the cross-section of the inner and outer tubes is square so that rotation of the outer tube 36 will also turn the inner tube 34, as is explained further below. The coupling of the floor engaging end 30 and ceiling engaging end 32 to the support post 22 will be explained in more details with reference to FIGS. 2*a* to 2*d*.

Figure 2D:
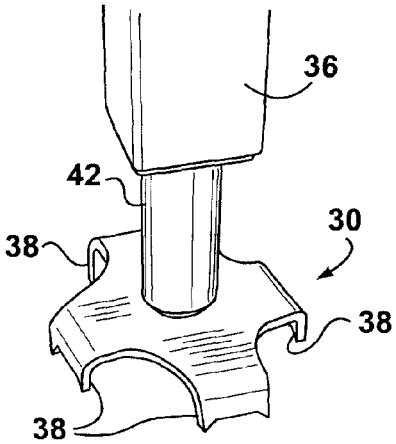
FIG. 2*d* is a perspective view showing a bottom end of the post of FIG. 2*a;*
Figure 3:
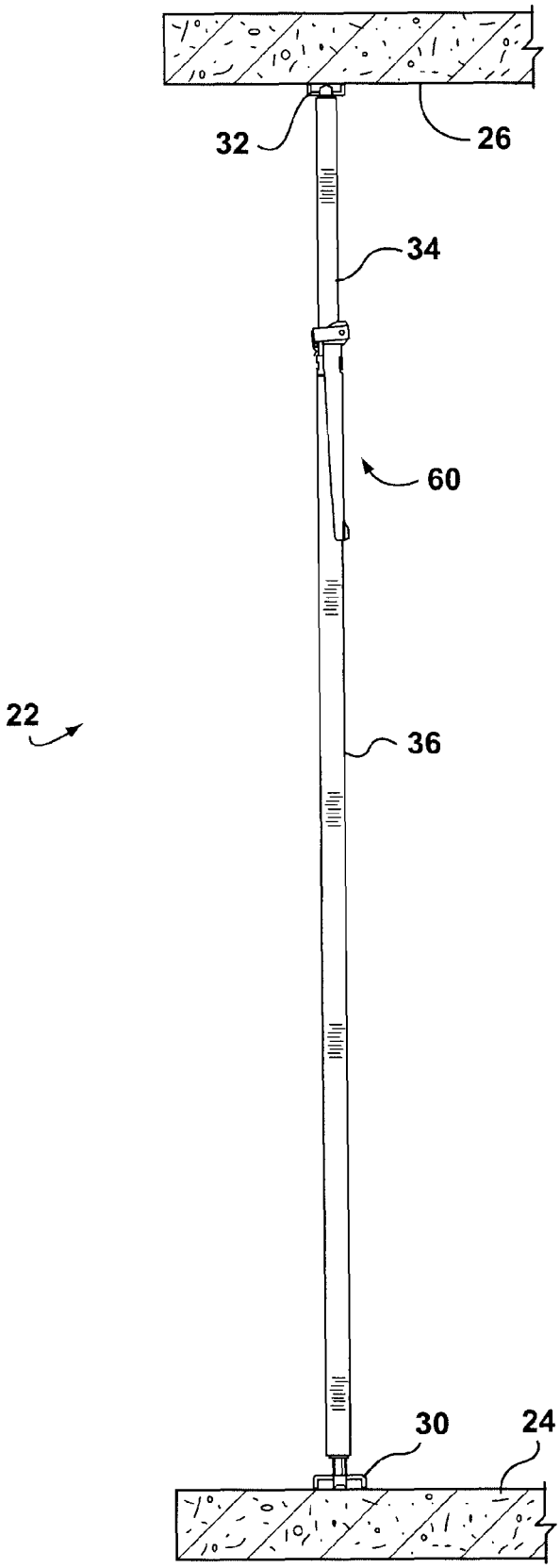
FIG. 3 is a side elevation view showing the post in position between floors of the building under construction.

As will be observed in the detail view of FIG. 2*d*, the foot 30 has a cruciform shape with four feet 38 each having a pair of sharp penetrating claws for firm engagement with a supporting surface. It will be observed that the claws are spaced apart and each has a length that is selected to limit penetration into a supporting surface. This configuration allows safety post 22 to come into firm engagement with the associated floor 24 and to penetrate any surface frost or dust which might otherwise interfere with safe operation of the post. By limiting penetration of the claws into an associated surface, damage to the surface is avoided.

As will observed from FIG. 2*c*, the ceiling engaging end 32 has a similar cruciform configuration with four feet 40 of similar shape. However, it will be observed that the separation between opposing pairs of feet 40 in the ceiling engaging end 32 is smaller than the separation between pairs of feet 38 in the floor engaging end 30. Thus, the floor engaging end 30 has a bigger "footprint" than the ceiling engaging end 32 for increased stability at the operatively lower end of the support post 22 where it needs to support any fence panels 28. Conveniently, the floor engaging end 30 and ceiling engaging end 32 can be nested thereby saving space during shipping.

The floor engaging end 30 is rotatably coupled to a reduced diameter portion of a shaft 42 which extends upwardly in the operative orientation of the support post 22. The shaft 42 is a solid steel bar that has a free end 44 approximately six inches in length that is threaded along its length and concealed from view inside the outer tube 36. The outer tube 36 has an internal nut 46 welded to its interior surface adjacent a lower end thereof and having complementary threads to the threaded end 44 of the shaft 42. The lower extremity of the outer tube 36 has a guide bushing 48 for sliding engagement with the shaft 42 and which closes the lower end of the outer tube 36 to prevent the ingress of dirt into the assembly. A plate 50 (as drawn) or pin is welded to the interior surface of the outer tube 36 above the height of the threaded end 44 of the shaft 42 to stop the telescoping inner tube from falling onto the shaft 42.

Figure 2A:
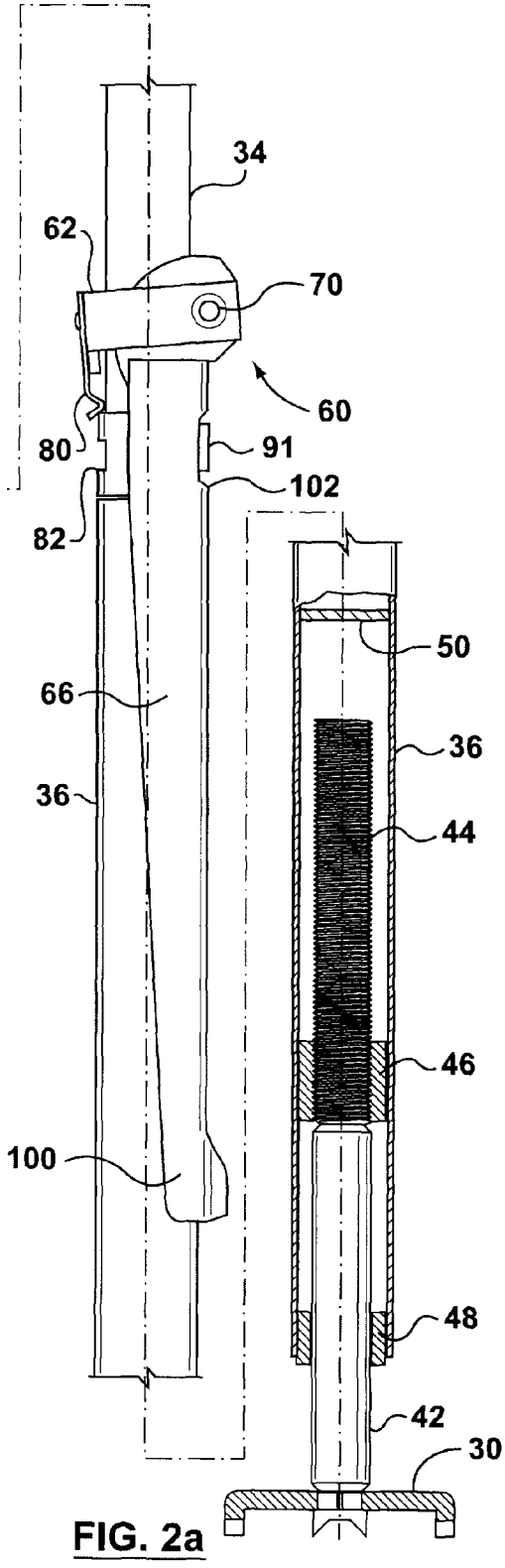
FIG. 2*a* is an assembly view of a post made in accordance with the invention.

The ceiling engaging end 32 is rotatably coupled to a stem 52 which is slidingly received in the operatively upper end of the inner tube 34. The stem 52 carries a longitudinally extending pin 54 which has a head that locates against a collar 56 welded to the interior surface of the inner tube 34. A top compression spring 58 is captured between the supporting collar 56 and the stem 52. Thus, the application of pressure to the ceiling engaging end 32 will cause the stem 52 to penetrate into the inner tube 34 and compress the compression spring 58 as illustrated by FIG. 2*a*. By contrast, FIG. 2*b* shows the ceiling engaging end 32 with the compression spring 58 in a relaxed configuration disengaged from the ceiling.

Figure 4:
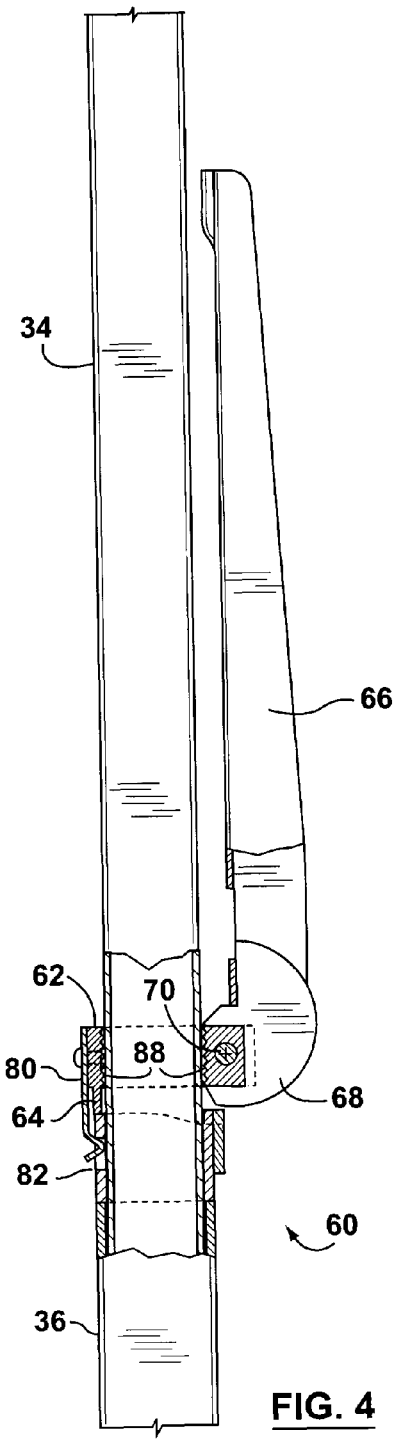
FIG. 4 is a detail partly-sectioned view of an over-centre locking lever assembly according to the invention.
Figure 5:
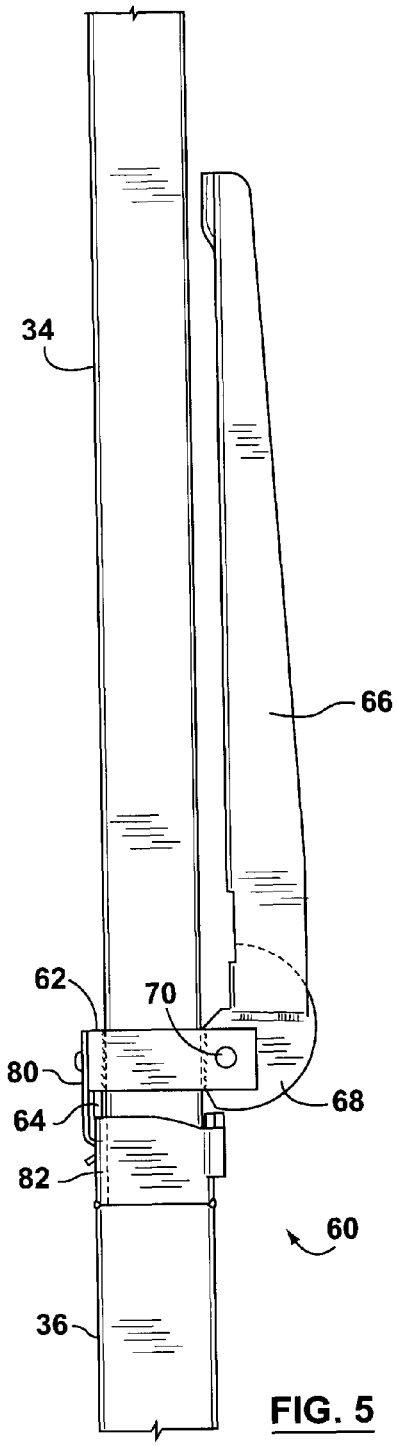
FIG. 5 is a similar view to FIG. 4 with no cross-section.

In accordance with this invention, an over-centre locking lever assembly 60 is provided for fixing the relative position of the telescoping inner tube 34 and outer tube 36. The locking lever assembly 60 is illustrated in FIG. 2*a* in its lock position. Its component parts will be described with reference to FIGS. 4 to 6 which are drawn to a larger scale and which show the locking lever assembly 60 in a release position. The operation of the locking lever assembly 60 to bring the assembly from a release position to a lock position will then be described with reference being made to FIGS. 7 to 10.

The over-centre locking lever assembly 60 consists of a collar 62 having a square cross-section which is somewhat larger than the cross-section of the inner tube 34 so that the collar 62 can slide longitudinally along the length of the inner tube 34. A downwardly extending lip 64 (as drawn) on one side of the collar 62 is disposed to rest on an upper peripheral edge of the telescoping outer tube 36. The opposite side of the collar 62 has a pivotally mounted lever 66 or handle which is bifurcated at its inner end into a pair of cam portions 68 that receive a pivot pin 70 therebetween. The pivot pin 70 is fixed to opposite sides of the collar 62 and defines a pivot axis 72 (FIG. 8) for rotation of the lever 66 as shown by arrows 74, 76, 78 in FIGS. 7, 9 and 10. A downwardly extending spring clip 80 extends from the collar 62 to rest in a recessed opening 82 formed in the upper portion of the outer tube 36.

Figure 7:
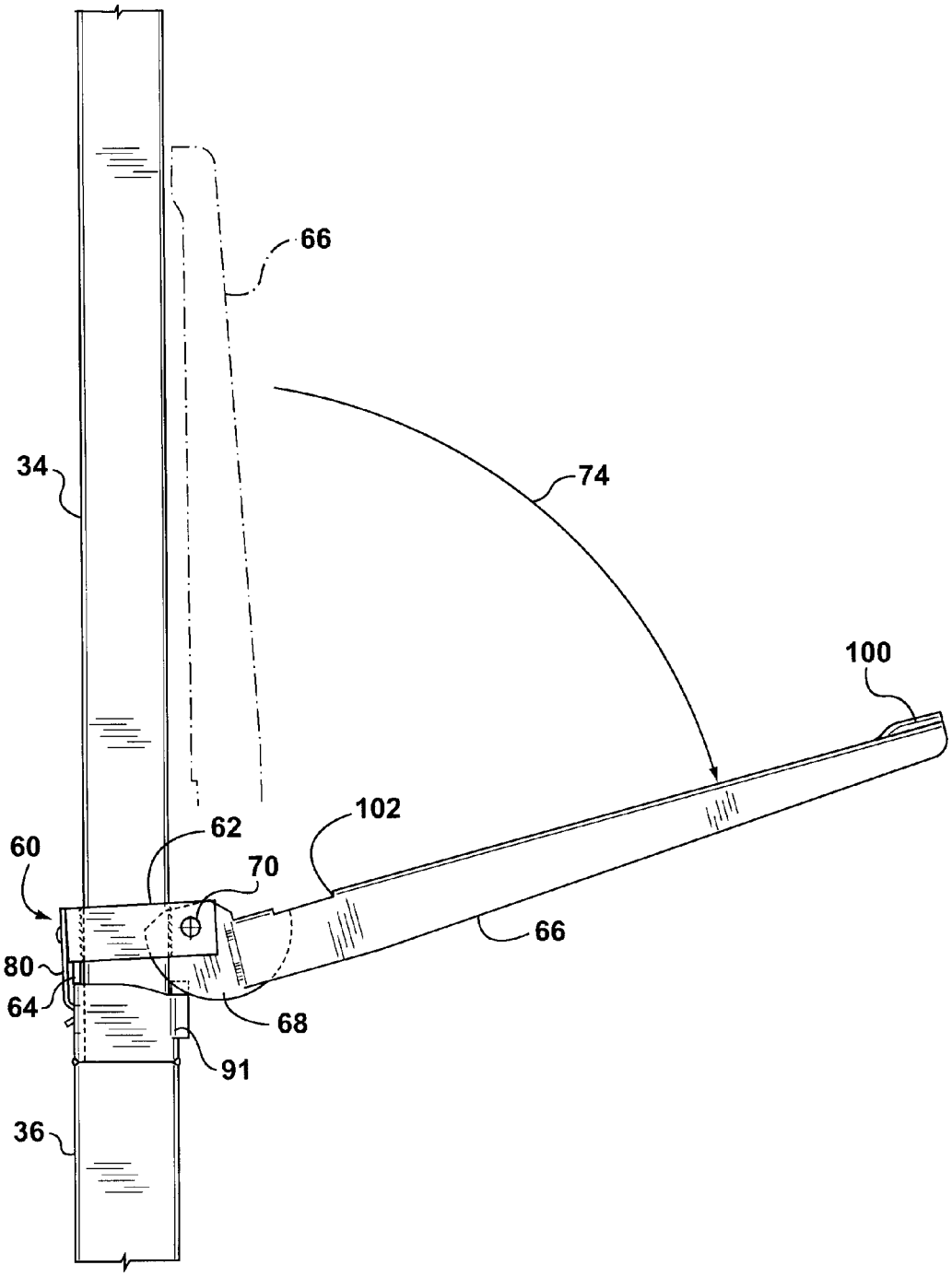
FIGS. 7, 9 and 10 are side elevation views showing the lever of FIG. 4 being lowered to a lock position.
Figure 8:
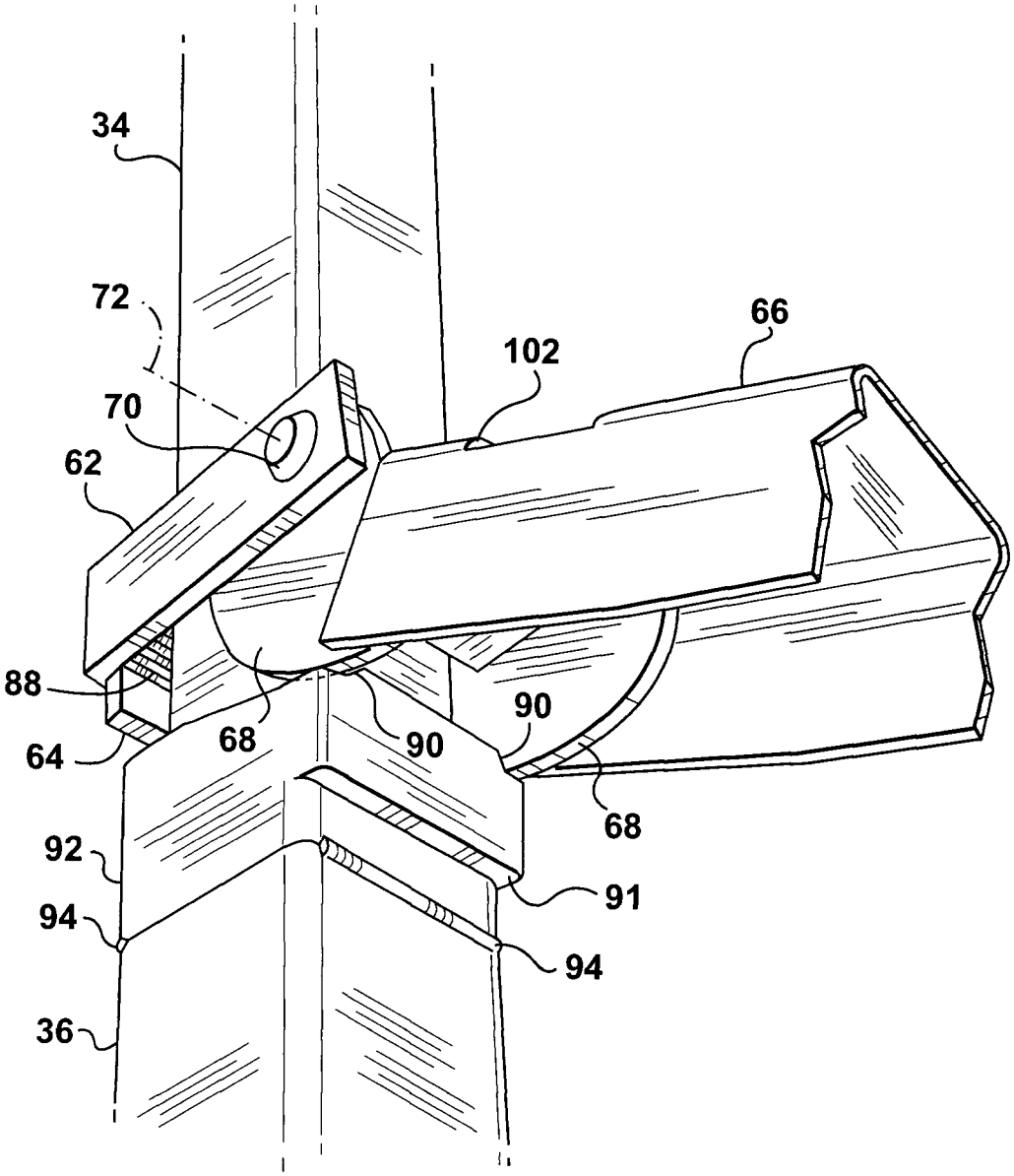
FIG. 8 is a perspective view drawn to a larger scale) showing the locking lever assembly with the lever in a position intermediate between a release position and a lock position.
Figure 9:
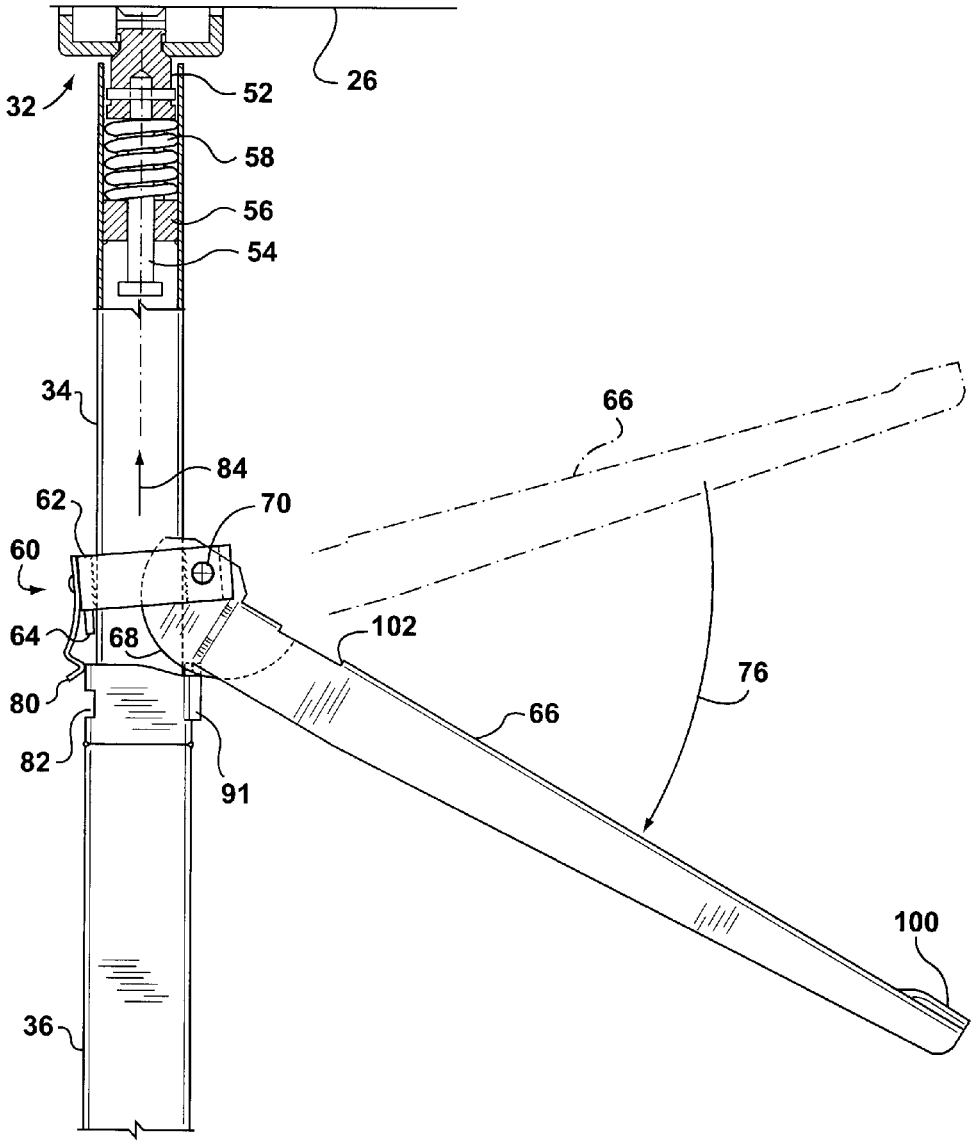

To operate the over-centre locking lever assembly 60, the telescoping inner tube 34 and telescoping outer tube 36 are separated from their rest position shown in FIG. 7 in solid line until the ceiling engaging end 32 is brought into engagement with the ceiling 26 as shown in FIG. 9. Meanwhile, the lever 66 is pivoted from its upright release position shown in chain-dotted line in FIG. 7 to its down lock position shown in solid line in FIG. 10. Pivotal movement of the lever 66 is guided by the cam portions 68 which have a curvature and shape adapted to raise the pivot pin 70 so that the collar 62 is raised above the upper peripheral edge of the telescoping outer tube 36 as shown by the separation between the lip 64 and the tube 36 in FIG. 9, and the dislodgement of the spring clip 80 from the recessed opening 82. Upward movement of the collar 62 is accompanied by a tilting movement so that the collar 62 is displaced from its horizontal release position to a transverse position where its inner surfaces engage the outer surface of the telescoping inner tube 34 and simultaneously cause the telescoping inner tube 34 to move upwardly as indicated by arrows 84, 86 shown in FIGS. 9 and 10. Upward movement of the telescoping inner tube 34 further compresses compression spring 58 against the stem 52 of the ceiling engaging end 32. To improve grip between the collar 62 and the telescoping inner tube 34, the inner surface of the collar 62 is roughened and consists of serrations 88 best seen in the cross-sectional view of FIG. 4. The titled configuration of the collar 62 is maintained by spring clip 80 resting against the outer surface of the telescoping inner tube 34.

In order to ensure that the lever 66 remains centered on the post 22 with the cam portions 68 engaging the upper peripheral edge of the telescoping outer tube 36, the telescoping outer tube 36 is made with somewhat thicker walls in the portions which engage the cam portions 68. The telescoping outer tube 36 also has oppositely disposed receiving grooves 90 formed in a thickened wall portion 91 (FIG. 8) which are angled outwardly to bias the cam portions 68 outwardly. Because of repeated wear on the upper peripheral edge of the telescoping outer tube 36, it may be made from a heat treated section 92 which is joined to the remainder of the telescoping outer tube 36 with a weld bead 94. Similarly, the collar 62 and cam portions 68 may be heat treated to prolong durability, maintain gripping in the serrations 88 and generally minimize wear and tear.

In an alternative embodiment of the invention, the cam portions 68 are replaced by straight edges and by a pivot bar that bears against the telescoping outer tube 36 as described with reference to FIGS. 13-16.

Figure 10:
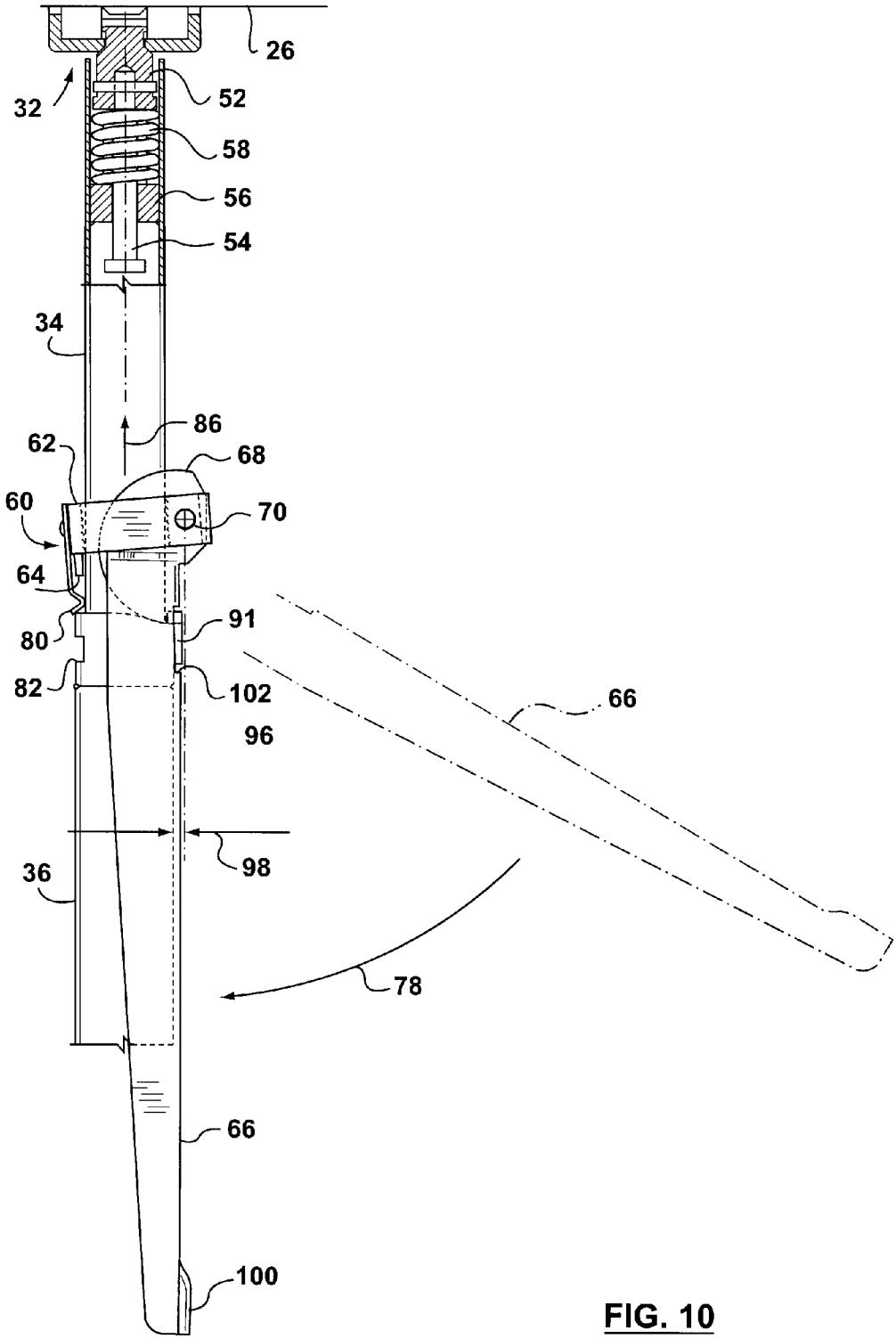

When the lever 66 is brought to rest against the telescoping outer tube 36 in its lock configuration shown by the solid line of FIG. 10, it moves past the center line 96 of the pivot pin 70 as shown by the double arrows 98 and therefore cannot fall away from the post 22 without being positively released. Release of the lever 66 from the post 22 is facilitated by forming a flared portion 100 in the end of the lever 66 remote from the pivot pin 70 which is adapted to receive the claw of a hammer or crowbar (not shown) so as to pry the lever 66 away from the post 22.

An opening 102 is formed in the lever 66 adjacent the cam portions 68 to receive and locate the thickened wall portion 91 of the telescoping outer tube 36.

Figure 11:
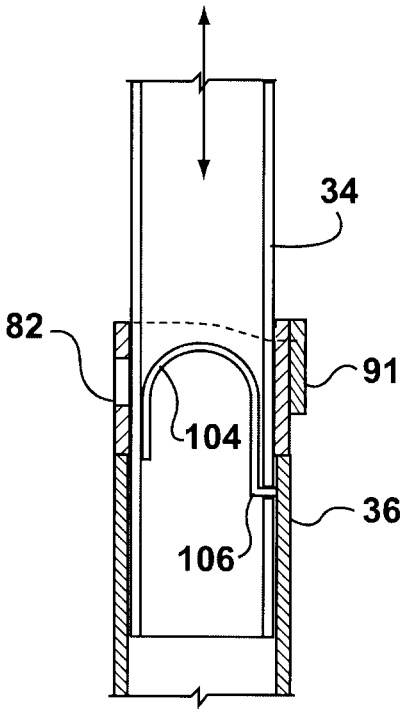
FIG. 11 is a partly sectioned view showing a leaf spring in frictional engagement with a telescoping outer tube.

Relative slipping between the telescoping inner and outer tubes 34, 36 is limited by engagement of the spring clip 80 against the telescoping inner tube 34, the thickened wall portion 91 of the outer tube 36 being received in the opening 102 of the lever 66 and by an inner leaf spring 104 shown in FIG. 11 which is disposed on the interior of telescoping inner tube 34 to frictionally engage the inner wall surface of telescoping outer tube 34 through an opening 106 formed in the telescoping inner tube 34 near the operatively bottom end thereof. The leaf spring 104 has a substantially U-shaped configuration with a lug that extends into the opening 106.

After release of the lever 66, the telescoping inner tube 34 drops a small amount sufficient to shorten the post 22 to a height which clears the separation between the ceiling 26 and the floor 24. The collar 62 is released from its tilted locking configuration by twisting the lever 66 or by hitting the collar 62 with a hammer.

During transportation of the post 22, the telescoping inner and outer tubes 34, 36 are maintained in position by engagement of the spring clip 80 in the receiving opening 82 formed in the telescoping outer tube 36 and by the continued frictional engagement of leaf spring 104 against the interior surface of telescoping outer tube 36.

It will be appreciated that fine adjustments up to an additional six inches may be made to extend the length of the post 22 and maintain optimum pressure on the ceiling engaging end 32.

To secure final placement of the support post 22, the outer tube 36 together with the inner tube 34 may be rotated on the threaded shaft 42. The thread of the threaded end 44 and the nut 46 are formed so that a counterclockwise rotation will bring about an upward vertical movement of the inner and outer tube assembly 34, 36. As pressure is applied to the ceiling engaging end 32, the inner tube 34 moves upwardly relative to the stem 52 thereby obscuring the stem from view. Conveniently the stem 52 may have a bright color applied to it such as a red colored band to provide a visual indication of the load being applied to the top compression spring 58. As observed in FIG. 2*a*, the inner tube 34 completely obscures the stem 52 when the compression spring 58 is fully loaded. It will be appreciated that the top compression spring 58 provides a means to respond in dynamic fashion to any small dimensional changes due to expansion or contraction of the floor and ceiling.

An alternative embodiment of the over-centre locking lever assembly will now be described with reference to FIGS. 13-16 and is generally indicated by reference numeral 120. Like numerals are used to identify parts common with the support post 22 described with reference to the preceding figures.

Accordingly, the post assembly has a telescoping inner tube 34 and a telescoping outer tube 36 with a U-shaped collar 62 that can slide longitudinally along the length of the telescoping inner tube 34. An internal surface of the collar 62 has serrations 88 for gripping engagement with the telescoping inner tube and a pivotally mounted lever 66 or handle is coupled to the collar 62 opposite from the serrations 88 at a first pivot pin 70. The handle 66 is bifurcated at its inner end to receive the pivot pin 70 between legs 66*a*, 66*b*. A housing 122 covers the pivot pin 70 to keep the pin 70 clean and to act as a bearing surface for a coil spring 124 as will be described.

Figure 13:
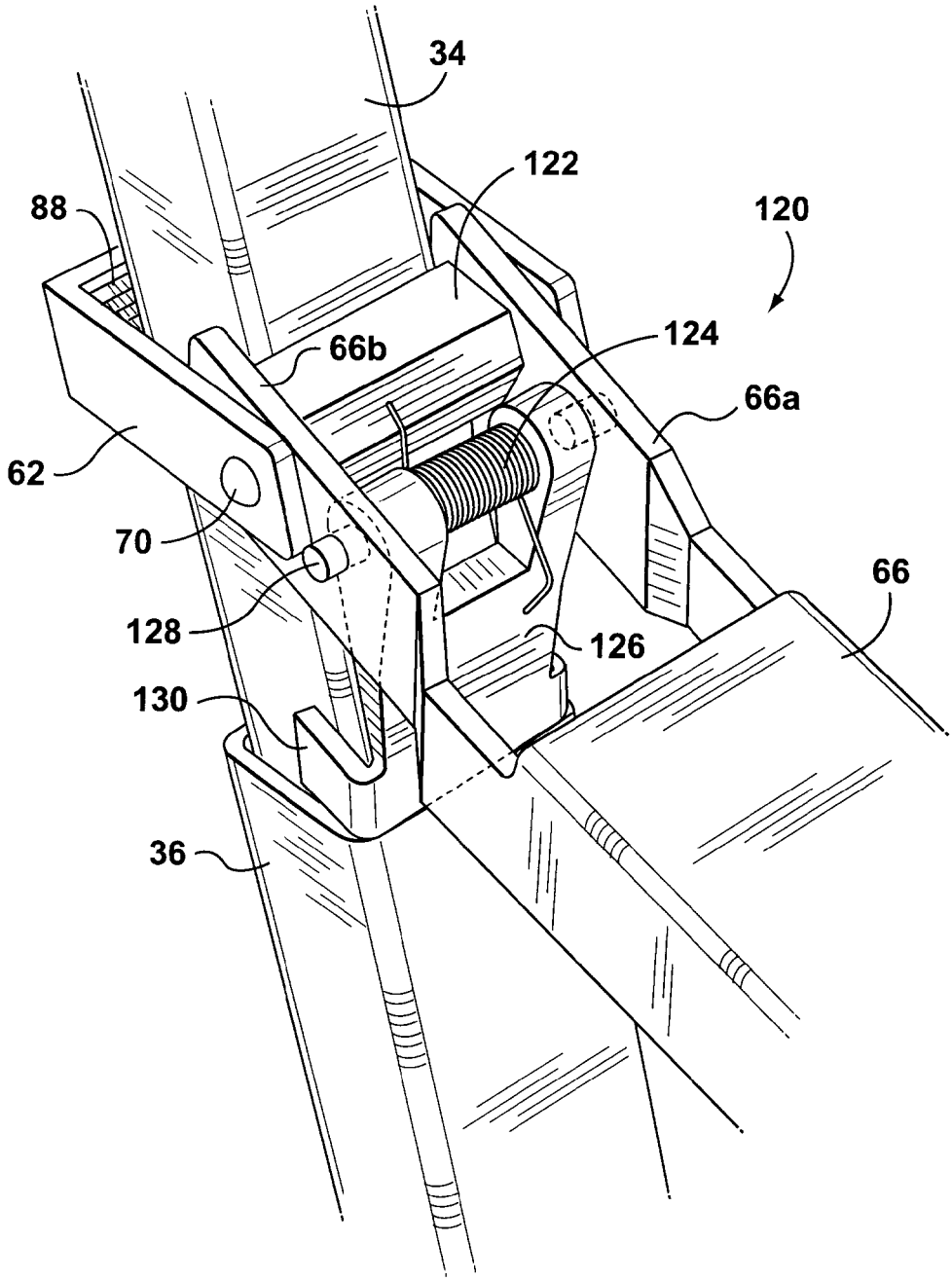
FIG. 13 is a perspective view similar to FIG. 8 of an alternative embodiment of a locking lever assembly in accordance with the invention.

A pivot bar 126 is pivotally mounted between legs 66*a*, 66*b* on a second pivot pin 128 extending therebetween and positioned between the first pivot pin 70 and the lever body 66. The pivot bar 126 is adapted to swing on the second pivot pin 128 to engage the upper peripheral surface of telescoping outer tube 36 with its free end as shown in FIG. 13. Side extensions 130 on opposite sides of the pivot bar 126 are dimensioned to capture the telescoping inner tube 34 therebetween.

Most preferably, the pivot bar 126 is itself bifurcated at the pivot end that receives pivot pin 128 and receives spring coil 124 therebetween with free ends of the spring coil 124 bearing on the housing 122 and on the pivot bar 126 to thereby urge the pivot bar 126 into engagement with the telescoping inner tube 34.

Figure 14:
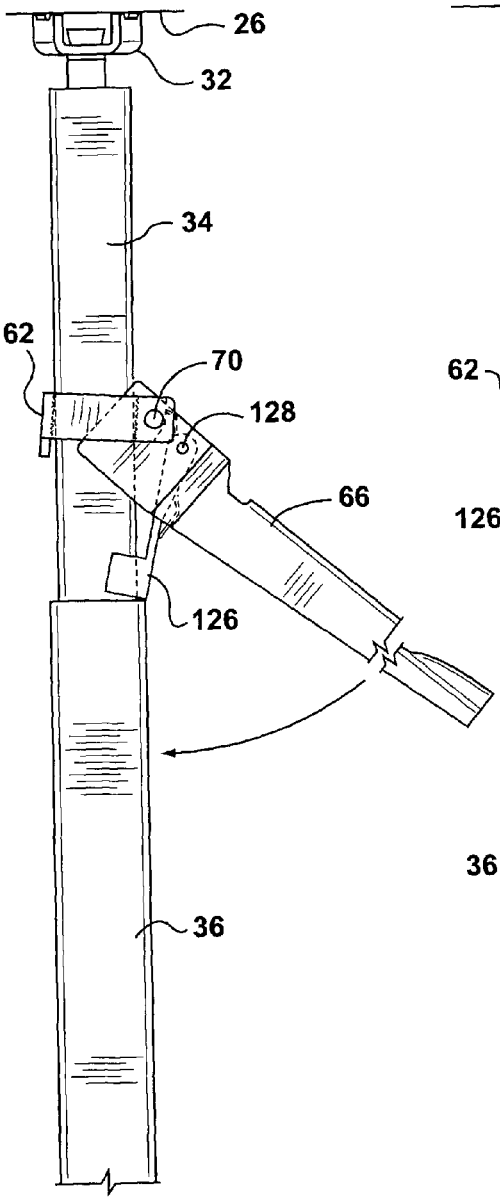
FIG. 14 is a front side elevation view of the lever of FIG. 13 being lowered into a lock position.

The operation of the over-centre locking lever assembly 120 is similar to the assembly 60 previously described. As seen in FIG. 14, the telescoping inner tube 34 and telescoping outer tube 36 are separated until the ceiling engaging end 32 is brought into engagement with the ceiling 26. Meanwhile, the lever 66 is pivoted from its upright release position to its down lock position until the pivot bar 126 engages the upper peripheral surface of the telescoping outer tube 36 and further on to raise the pivot pin 70 and the collar 62. Upward movement of the collar 62 is accompanied by a tilting movement so that the collar 62 is displaced from its horizontal release position to a transverse position where its inner surfaces engage the outer surface of the telescoping inner tube 34 and simultaneously causes the telescoping inner tube 34 to move upwardly as indicated by arrow 132 shown in FIG. 15.

Figure 15:
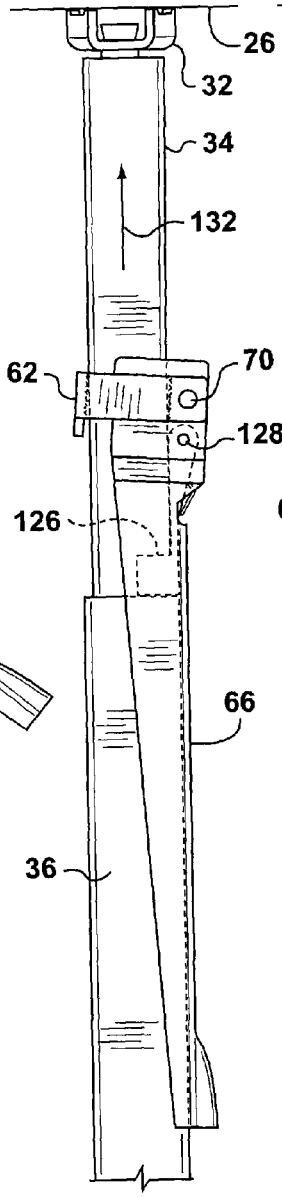
FIG. 15 is a front side elevation view of the lever of FIG. 13 in the lock position.
Figure 16:
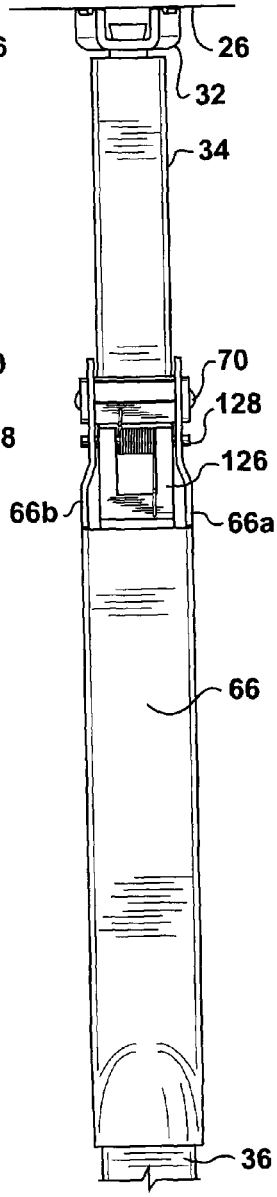
FIG. 16 is lateral side elevation view of the lever of FIG. 13 in the lock position.

When the lever 66 is brought to rest against the telescoping outer tube 36 in its lock configuration shown in FIG. 15 it moves past a center line of the pivot pin 70 and therefore cannot fall away without being positively released.

Industrial Applicability

Once positioned, the support post 22 is extremely stable and secure so that it can successfully withstand pull or push tension tests applied to its mid portion thereby complying with regulations of the applicable health and safety legislation or other legislation.

Figure 1:
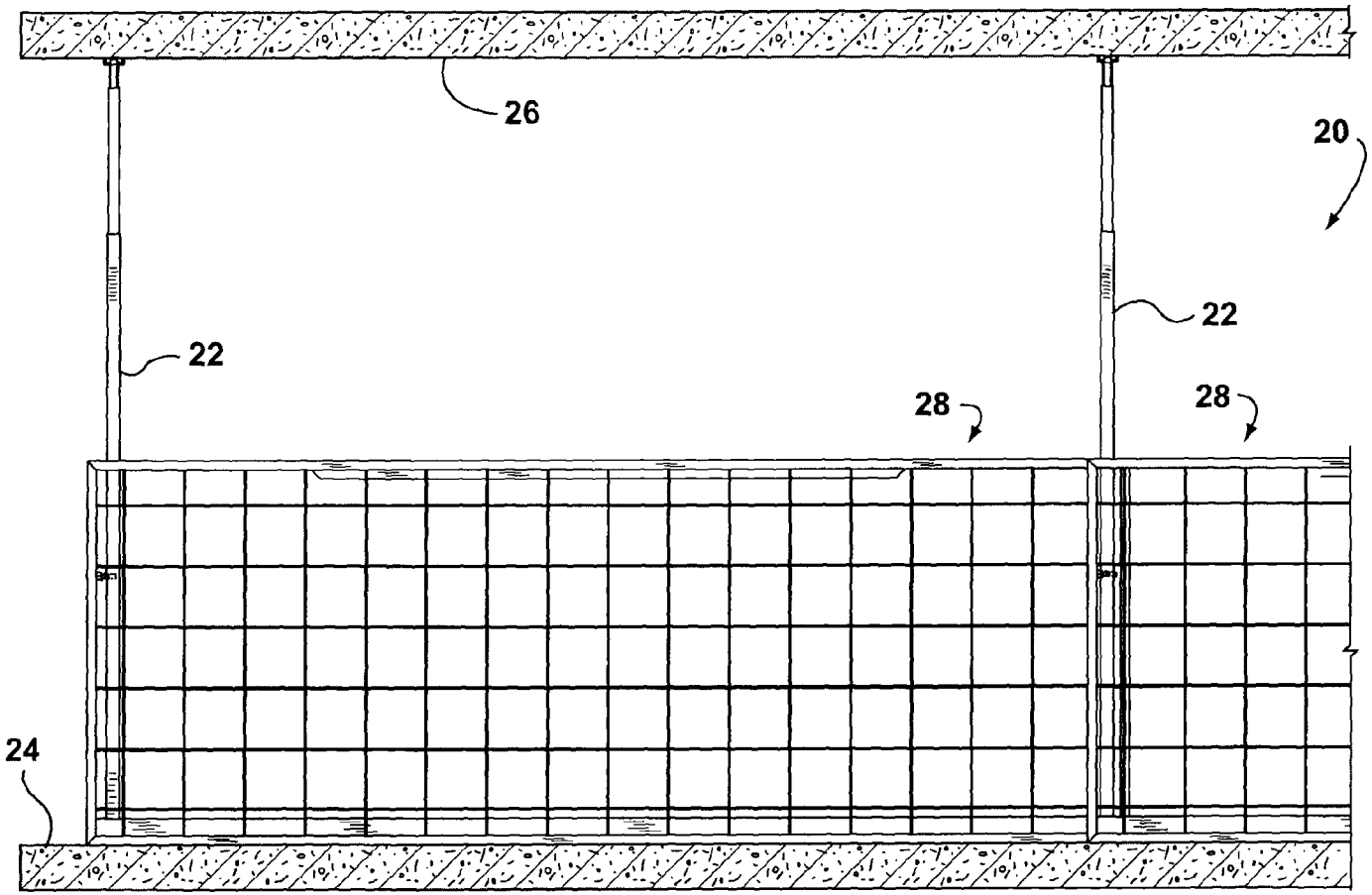
FIG. 1 is a side elevation view of a safety post and fence assembly positioned between two floors of a building under construction.

In use, the support post 22 is erected at selected locations and a plurality are positioned at suitable distances required to support fence panels positioned in overlapping fashion as shown in FIG. 1 in order to form a security barrier.

As will be appreciated by those skilled in the art, several variations may be made to above-described embodiment of the invention within the scope of the appended claims.

INDEX OF REFERENCE NUMERALS

20 safely fence assembly
22 support post

24 floor
26 ceiling
28 fence panel
30 foot engaging end
32 ceiling engaging end
34 telescoping inner lube
36 telescoping outer tube
38 feel (floor)
40 feel (ceiling)
42 shafl
44 free end (shaft)
46 internal nut
48 guide bushing
50 plate
52 stem
54 pin
56 collar
58 lop compression spnng
60 over-centre locking lever assembly
62 collar
64 lip
66 lever/handle
68 cam portions
70 pivot pin
72 pivot axis
74 arrows
76 arrows
78 arrows
80 spring clip
82 opening
84 arrows
86 arrows
88 serrations
90 grooves
82 heat treated section
94 weld bead
96 center line
98 arrows
100 flared portion
102 opening
104 leaf spring
106 opening
110 wire clip
112 hook
114 bend
120 over-centre locking lever assembly
122 housing
124 coil spring
128 pivot pin
130 side extensions
132 arrow

The invention claimed is:

1. A support post for a safety fence assembly, the post having a floor engaging end, the floor engaging end having a number of claws, each claw having a number of sharp penetrating points for engagement with a supporting surface, a shaft coupled at one end to said floor engaging end and having a free end which is threaded along at least a portion of its length, a first longitudinally extending telescoping tube having an internal nut for threaded engagement with said shaft, a second longitudinally extending telescoping tube adapted for sliding telescoping engagement with said first telescoping tube;

a ceiling engaging end coupled to said second telescoping tube; and an over-centre locking lever assembly for fixing the relative position of the first and second telescoping tubes.

2. A post according to claim 1 in which each claw has a pair of spaced apart points, each point having a length selected to limit penetration into a supporting surface.

3. A post according to claim 1 in which the ceiling engaging end consists of a number of claws each having a number of sharp penetrating points for firm engagement with a supporting surface.

4. A post according to claim 3 in which each claw has a pair of spaced apart points, each point having a length selected to limit penetration into a supporting surface.

5. A post according to claim 1 in which the floor engaging end is rotatably coupled to the shaft.

6. A post according to claim 1 in which the ceiling engaging end has a stem slidingly received in the second tube, and a top compression spring captured between the stem and a supporting collar fixed to an interior surface of the second tube.

7. A post according to claim 6 in which the ceiling engaging end is rotatably coupled to the stem.

8. A support post for a safety fence assembly, the post having a floor engaging end, a shaft coupled at one end to said floor engaging end and having a free end which is threaded along at least a portion of its length, a first longitudinally extending telescoping tube having an internal nut for threaded engagement with said shaft, a second longitudinally extending telescoping tube adapted for sliding telescoping engagement with said first telescoping tube;

a ceiling engaging end coupled to said second telescoping tube; and an over-centre locking lever assembly for fixing the relative position of the first and second telescoping tubes;

wherein the over-centre locking lever assembly includes a collar slideable longitudinally over an inner one of said first and second telescoping tubes, and a lever pivotally mounted to the collar on a first pivot pin and pivotable between a release position where the collar is freely movable on said inner telescoping tube and a lock position where the lever has moved past a center line of the pivot pin parallel to the support post and the collar is tilted to grip the inner telescoping tube.

9. A support post according to claim 8 in which the lever is bifurcated at an inner end into a pair of leg portions that receive the first pivot pin therebetween, the over-centre locking lever assembly further including a pivot bar pivotable on a second pivot pin extending between said leg portions and positioned between the first pivot pin and an outer end of the lever, the pivot bar having a free end to engage an upper peripheral edge of an outer one of said first and second telescoping tubes so that the collar may be raised above the upper peripheral edge of the telescoping outer tube and tilted to grip an outer surface of the telescoping inner tube.

10. A support post, according to claim 9 having a coil spring disposed on said second pivot pin, the coil spring having one free end bearing on the first pivot pin and a second free end bearing on the pivot bar to urge the pivot bar into engagement with the telescoping inner tube.

11. A support post according to claim 8 in which the collar has an inside surface which is serrated to better grip an outer surface of the inner telescoping tube.

12. A support post according to claim 8 in which the collar has a longitudinally extending lip on one side of the collar opposite from said lever for resting on an upper peripheral edge of an outer one of said telescoping first and second tubes.

13. A support post according to claim 8 in which the collar has spring biasing means opposite from said pivot pin and adapted to maintain said collar in said tilted orientation for gripping the inner telescoping tube.

14. A support post according to claim 13 in which the outer one of said first and second telescoping tubes has an opening for receiving the spring biasing means in a release position of the over-centre locking lever assembly.

15. A support post according to claim 8 in which the lever has a flared portion remote from said pivot pin adapted to receive means for prying the lever back over said center line of the pivot pin to a release position.

16. A support post according to claim 8 having an inner leaf spring disposed inside the inner one of said first and second telescoping tubes, said inner tube having openings for receiving said leaf spring and allowing the leaf spring to frictionally engage the outer one of said telescoping first and second tubes.

17. A support post for a safety fence assembly, the post having:

a floor engaging end;

a shaft coupled at one end to said floor engaging end and having a free end coupled to a first longitudinally extending telescoping tube;

a second longitudinally extending telescoping tube adapted for sliding telescoping engagement with said first telescoping tube;

a ceiling engaging end coupled to said second telescoping tube; and an over-centre locking lever assembly for fixing the relative position of the first and second telescoping tubes, the over-centre locking lever assembly including a collar slideable longitudinally over an inner one of said telescoping first and second tubes, and a lever pivotally mounted to the collar on a first pivot pin and pivotable between a release position where the collar is freely movable on said inner telescoping tube and a lock position where the lever has moved past a center line of the first pivot pin parallel to the support post and the collar is tilted to grip the inner telescoping tube.

18. A support post according to claim 17 in which the lever is bifurcated at an inner end into a pair of leg portions that receive the first pivot pin therebetween, the over-centre locking lever assembly further including a pivot bar pivotable on a second pivot pin extending between said leg portions and positioned between the first pivot pin and an outer end of the lever, the pivot bar having a free end to engage an upper peripheral edge of an outer one of said first and second telescoping tubes so that the collar may be raised above the upper peripheral edge of the telescoping outer tube and tilted to grip an outer surface of the telescoping inner tube.

19. A support post, according to claim 18 having a coil spring disposed on said second pivot pin, the coil spring having one free end bearing on the first pivot pin and a second free end bearing on the pivot bar to urge the pivot bar into engagement with the telescoping inner tube.

20. An over-centre locking lever assembly for fixing the relative position of telescoping inner and outer tubes in a support post for a safety fence assembly, the assembly including a collar slideable longitudinally over the inner one of said telescoping tubes, and a lever pivotally mounted to the collar on a first pivot pin and pivotable between a release position where the collar is freely movable on said inner telescoping tube and a lock position where the lever has moved past a center line of the pivot pin parallel to the support post, the lever being bifurcated at an inner end into a pair of leg portions that receives the first pivot pin therebetween, the over-centre locking lever assembly further including a pivot bar pivotable on a second pivot pin extending between said leg portions and positioned between the first pivot pin and an outer end of the lever, the pivot bar having a free end to engage an upper peripheral edge of an outer one of said first and second telescoping tubes so that the collar may be raised above the upper peripheral edge of the telescoping outer tube and tilted to grip an outer surface of the telescoping inner tube.

21. A support post, according to claim 20 having a coil spring disposed on said second pivot pin, the coil spring having one free end bearing on the first pivot pin and a second free end bearing on the pivot bar to urge the pivot bar into engagement with the telescoping inner tube.

* * * * *